US011117714B2

(12) United States Patent
Green

(10) Patent No.: US 11,117,714 B2
(45) Date of Patent: Sep. 14, 2021

(54) STORAGE CONTAINER WITH MULTIPLE LOCKING MECHANISMS

(71) Applicant: Jeff Green, Beverly Hills, CA (US)

(72) Inventor: Jeff Green, Beverly Hills, CA (US)

( * ) Notice: Subject to any disclaimer, the term of this patent is extended or adjusted under 35 U.S.C. 154(b) by 218 days.

(21) Appl. No.: 16/450,551

(22) Filed: Jun. 24, 2019

(65) Prior Publication Data

US 2020/0399026 A1 Dec. 24, 2020

(51) Int. Cl.
*B65D 43/02* (2006.01)
*B65D 21/02* (2006.01)

(52) U.S. Cl.
CPC ..... *B65D 43/0212* (2013.01); *B65D 21/0222* (2013.01); *B65D 2543/00194* (2013.01)

(58) Field of Classification Search
CPC ..... B65D 43/0212; B65D 21/0222; B65D 2543/00194; B65D 21/0223; B65D 43/22; B65D 45/18
USPC ..... 220/324, 326, 784, 788
See application file for complete search history.

(56) References Cited

U.S. PATENT DOCUMENTS 3,416,701 A * 12/1968 Kramer ..... B65D 25/2852 220/318
4,520,943 A * 6/1985 Nielsen ..... B65D 21/0233 220/281
D319,016 S 8/1991 Kahl
5,040,834 A * 8/1991 Kahl ..... E05C 3/048 292/204
5,065,885 A * 11/1991 Scaroni ..... B65D 45/22 220/326
D326,345 S 5/1992 Mandell et al.
5,125,697 A * 6/1992 Kahl ..... E05C 3/048 220/315
5,193,706 A 3/1993 Hanna et al.
5,507,385 A 4/1996 Koloski et al.
5,524,554 A * 6/1996 Wilson ..... B65D 19/004 108/53.1
5,564,805 A * 10/1996 Dickinson ..... B25H 3/02 206/505
D378,552 S 3/1997 Lippisch
D427,769 S 7/2000 Zimmerman
6,085,928 A 7/2000 Dickinson et al.
D480,650 S 10/2003 Tanji
D480,872 S 10/2003 Welsh et al.
6,666,348 B2 * 12/2003 Fore ..... B65D 1/26 220/315
6,789,692 B2 9/2004 Prezelin
D511,624 S 11/2005 Rosine et al.
D513,870 S 1/2006 Rosine et al.
D519,734 S 5/2006 Richardson et al.
D643,628 S 8/2011 Monarch
D643,629 S 8/2011 Sofy et al.
D645,248 S 9/2011 Osiecki et al.
D653,450 S 2/2012 Walter
D670,111 S 11/2012 McNamara
D701,044 S 3/2014 Kishimoto
D708,875 S 7/2014 McNamara
D719,713 S 12/2014 Burgess et al.
(Continued)

*Primary Examiner* — James N Smalley
(74) *Attorney, Agent, or Firm* — Lewis Roca Rothgerber Christie LLP

(57) ABSTRACT

A storage container has a lid and a base, a first releasable locking mechanism including a snap-fit coupling between the lid and the base and a second releasable locking mechanism including a hinged coupling between the lid and the base.

18 Claims, 7 Drawing Sheets

(56) References Cited

U.S. PATENT DOCUMENTS

| | | | | |
|---|---|---|---|---|
| D725,387 | S | 3/2015 | Masalin et al. | |
| D726,415 | S | 4/2015 | Masalin et al. | |
| 9,114,909 | B2 | 8/2015 | Wagner | |
| D737,574 | S | 9/2015 | Reinhart | |
| D738,623 | S | 9/2015 | Wood | |
| D741,171 | S | 10/2015 | Thurin et al. | |
| D752,973 | S | 4/2016 | Thurin et al. | |
| D759,972 | S | 6/2016 | Duvigneau | |
| D785,940 | S | 5/2017 | Reed | |
| D788,465 | S | 6/2017 | Spadotto | |
| D790,337 | S | 6/2017 | Sofy et al. | |
| D807,123 | S | 1/2018 | Carey et al. | |
| D807,124 | S | 1/2018 | Carey et al. | |
| D816,995 | S | 5/2018 | Fleming et al. | |
| D818,712 | S | 5/2018 | Fleming et al. | |
| D818,713 | S | 5/2018 | Fleming et al. | |
| D821,665 | S | 6/2018 | Bramwell | |
| D821,749 | S | 7/2018 | Nilsson | |
| D821,808 | S | 7/2018 | Diner | |
| D826,557 | S | 8/2018 | Han | |
| D827,386 | S | 9/2018 | Ichikawa | |
| 10,064,507 | B1 * | 9/2018 | Shih | B65D 51/18 |
| D830,765 | S | 10/2018 | Croft et al. | |
| D833,149 | S | 11/2018 | Sofy et al. | |
| D833,211 | S | 11/2018 | Croft et al. | |
| D836,995 | S | 1/2019 | Carey et al. | |
| D837,588 | S | 1/2019 | Croft et al. | |
| 10,450,104 | B2 * | 10/2019 | Han | B65D 43/167 |
| 2009/0276982 | A1 * | 11/2009 | Nossa | B65D 43/22 24/305 |
| 2018/0265263 | A1 | 9/2018 | Li | |

* cited by examiner

STORAGE CONTAINER WITH MULTIPLE LOCKING MECHANISMS

FIELD

The present disclosure relates generally to storage containers.

BACKGROUND

Containers are used to store and/or transport a variety of items. Generally, a user accesses the contents of a container by removing a lid. However, while a detachable lid provides an access point for a user, the lid may be a weaker feature of the container. For example, the contents of the container may force the lid open and spill out (e.g., if the container is tightly packed or tips over). Additionally, a user may want to stack another container on the lid which requires the lid to provide a balanced, stable surface for stackability. Therefore, due to the nature of container storage, reliably and effectively securing the lid to the container while providing a stable surface for stacked containers may be challenging.

SUMMARY

The present disclosure is directed to various embodiments of a storage container with a dual locking mechanism including a first releasable locking mechanism and a second releasable locking mechanism. In some embodiments, the first releasable locking mechanism includes a distal inwardly-facing projection of a lid and an undercut in an upper lip of a base. The first releasable locking mechanism is set/locked when the distal inwardly-facing projection of the lid engages the undercut in the upper lip of the base. By setting/locking the first releasable locking mechanism, the lid engages the upper lip of the base. In some embodiments, the storage container includes a second releasable locking mechanism. The second releasable locking mechanism includes a projection protruding from an inner surface of a latch coupled to the upper lip of the base and a corresponding recess in an end portion of a periphery of the lid. To set/lock the second releasable locking mechanism, a user rotates the latch to engage the projection with the corresponding recess in the end portion of the periphery of the lid. In some embodiments, the lid includes one or more grooves to accommodate outer feet of a storage container allowing a user to guide and reinforce vertical stacking of multiple storage containers.

In some embodiments, a storage container includes:

a lid having an inwardly-facing projection and one selected from the group consisting of a male element and a female element;

a base having an upper lip and a latch with another selected from the group consisting of a male element and a female element;

a first releasable locking mechanism including a snap-fit coupling between the inwardly-facing projection and the upper lip; and a second releasable locking mechanism including a hinged coupling between the one and another of the group consisting of a male element and a female element.

In some embodiments, the second releasable locking mechanism is outside of the first releasable locking mechanism when the first and second releasable locking mechanisms are both in their locked positions.

In some embodiments, the second releasable locking mechanism generally encloses the first releasable locking when the first and second releasable locking mechanisms are both in their locked positions.

In some embodiments, the latch has an upper portion and a lower portion, the upper portion and the lower portion defining an angle therebetween.

In some embodiments, the wall includes a channel configured to releasably engage with the latch.

In some embodiments, the another selected from the group consisting of a male element and a female element is formed on the upper portion of the latch.

In some embodiments, the latch extends over an end portion of a periphery of the lid when the second releasable locking mechanism is in its locked position.

In some embodiments, the lower portion includes a generally cylindrical member defining a pivot axis about which the latch is configured to move between a locked position and an unlocked position.

In some embodiments, the upper lip of the base includes a fingerhold indentation.

In some embodiments, the fingerhold indentation is configured to remain generally unobstructed by the latch whether the latch is in a locked position or an unlocked position.

In some embodiments, the storage container includes a first locking mechanism and a second locking mechanism at each end of the container.

In some embodiments, a storage container includes:

a lid having an inwardly-facing projection and one selected from the group consisting of a male element and a female element, the one being located at a periphery of the lid;

a base having an upper lip and a latch with another selected from the group consisting of a male element and a female element;

a first releasable coupling between the inwardly-facing projection and an undercut in the upper lip; and a second releasable coupling between the one and another of the group consisting of a male element and a female element, wherein the second releasable coupling is outside of the first releasable coupling when the first and second releasable couplings are both in their locked positions.

In some embodiments, the second releasable coupling generally encloses the first releasable coupling when the first and second releasable couplings are both in their locked positions.

In some embodiments, the latch has an upper portion and a lower portion, the upper portion and the lower portion defining an angle therebetween.

In some embodiments, the lower portion including a generally cylindrical member defining a pivot axis about which the latch is configured to move between a locked position and an unlocked position.

In some embodiments, the lid has a concavity formed in an upper surface of the periphery of the lid.

In some embodiments, the latch extends over an end portion of the periphery of the lid and extends partially over the concavity when the second releasable coupling is in its locked position.

In some embodiments, the upper lip of the base includes a fingerhold indentation.

In some embodiments, the fingerhold indentation is configured to remain generally unobstructed by the latch whether the latch is in a locked position or an unlocked position.

In some embodiments, the lid has a plurality of grooves configured to guide and reinforce vertical stacking of another base on top of the lid.

In some embodiments, each of the plurality of grooves has an L-shape and each leg of the L-shape is parallel to an edge of the lid.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

DETAILED DESCRIPTION

The following detailed description should be read with reference to the drawings, in which like elements in different drawings are identically numbered. The drawings, which are not necessarily to scale, depict selected embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention.

Figure 1A:
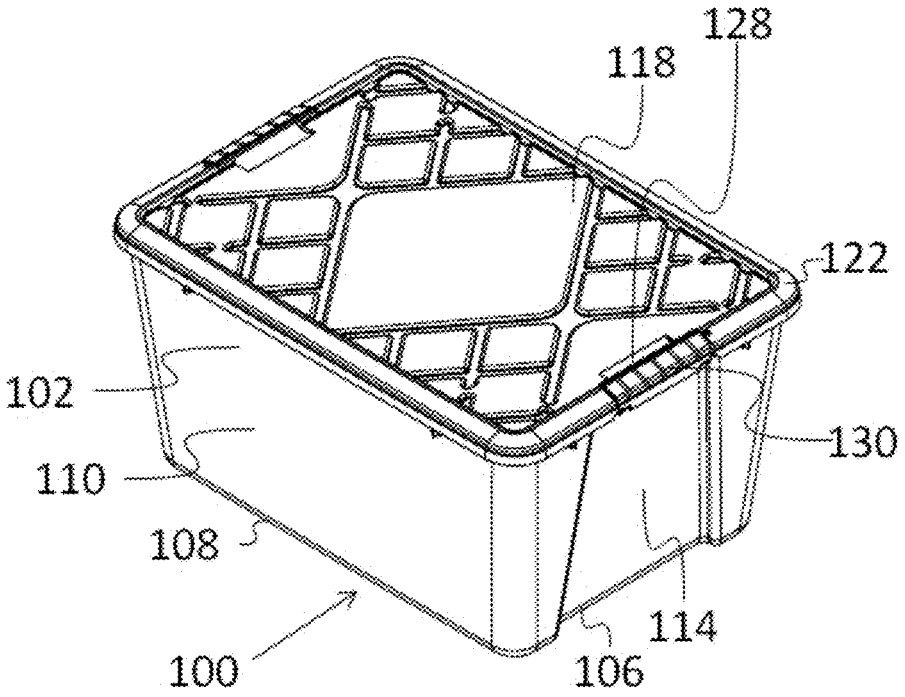
FIG. 1A is a perspective view of a storage container with a first and a second releasable locking mechanism locked according to one embodiment of the present disclosure.
Figure 1B:
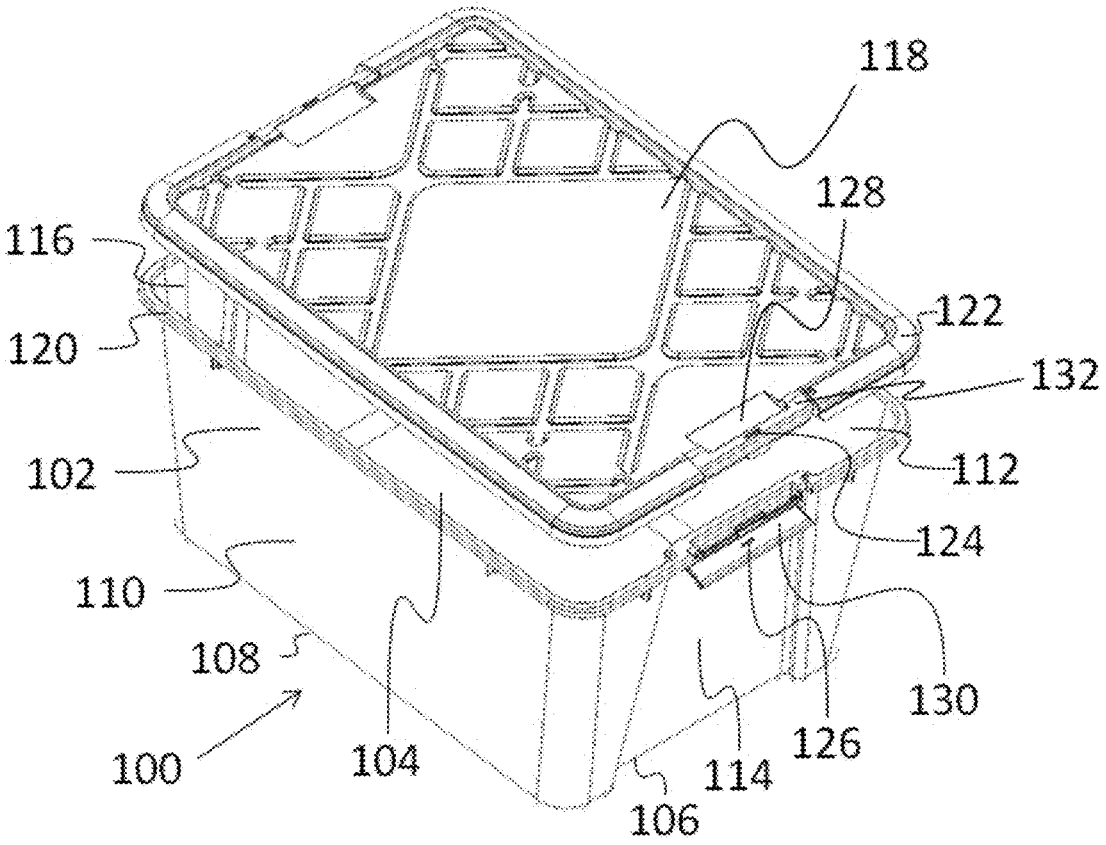
FIG. 1B is an exploded perspective view of the storage container in FIG. 1A.

With reference now to FIG. 1A and FIG. 1B, a storage container 100 according to some embodiments of the present disclosure includes a base 102 with a bottom 104 having opposing end edges 106 and opposing side edges 108, a first and second side walls 110, 112 extending upwardly from the opposing side edges 108, a first and second end walls 114, 116 extending upwardly from the opposing end edges 106. The bottom 104 and the walls 110, 112, 114, 116 collectively define an interior volume V which, in some embodiments, may be sealed with a fully detachable lid 118. In the illustrated embodiment, the first and second side walls 110, 112 and the first and second end walls 114, 116 are tapered to allow the storage container to stackably nest within another similar or identical storage container when the containers are empty and respective lids are detached. In some embodiments, the base 102 includes an upper lip 120 that surrounds an upper opening into the interior volume V of the base 102. The base 102 and the lid 118 may be constructed of any suitable material, including, for example, polypropylene.

With reference now to FIG. 1A, FIG. 1B, FIG. 2, FIG. 3A, and FIG. 3B, the lid 118 has a periphery 122 configured to engage with the upper lip 120 of the base 102. To releasably and reliably lock the periphery 122 and the upper lip 120 to each other, the storage container 100 at each end provides a first locking mechanism and a second locking mechanism. Each first locking mechanism includes a downward snap-fit coupling and each second locking mechanism includes an upward hinged coupling so that the lid and the base are coupled to each other in a manner that resists detachment upon exposure to either a downward or an upward impact force as shown in FIG. 1A.

With reference to the first locking mechanism, in the region of each end wall 114 and 116, the upper lip 120 of the base 102 has a finger-hold indentation 121 having an upside down "U" cross-section with a vertical extension that provides an undercut 308. Correspondingly, an end portion 132 of the periphery 122 of the lid 118 has a generally-vertical L portion with an outer surface 302, an inner surface 304, and a distal inwardly-facing projection 306 extending from a leg of the L portion. The distal inwardly-facing projection 306 is configured to extend into the undercut 308 in the upper lip 120 of the base 102 when providing the downward snap-fit coupling of the first releasable locking mechanism. In some embodiments, the undercut 308 has a sufficient depth to accommodate a user's fingers to facilitate user access to the inwardly-facing projection 306.

Figure 3A:
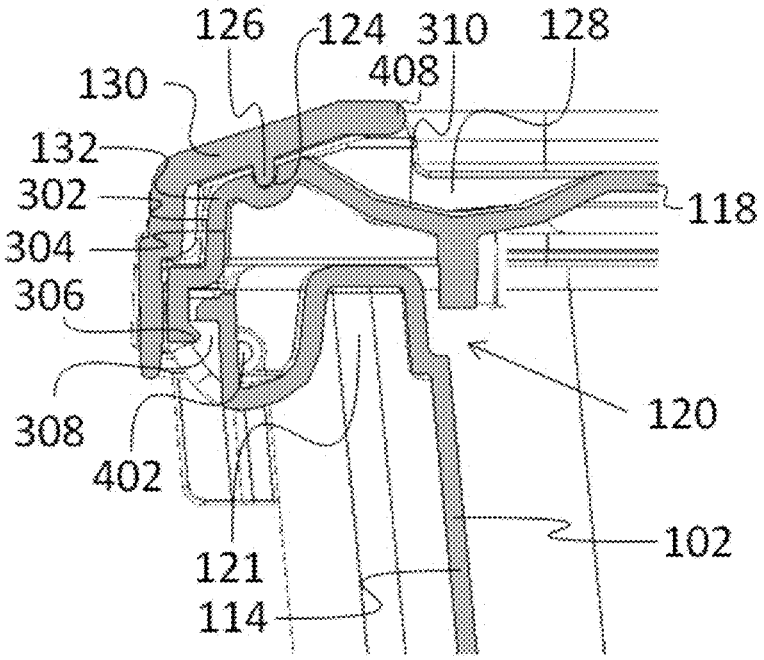
FIG. 3A is a cross-sectional view of FIG. 2, taken along line A-A with a first and a second releasable locking mechanism locked.
Figure 3B:
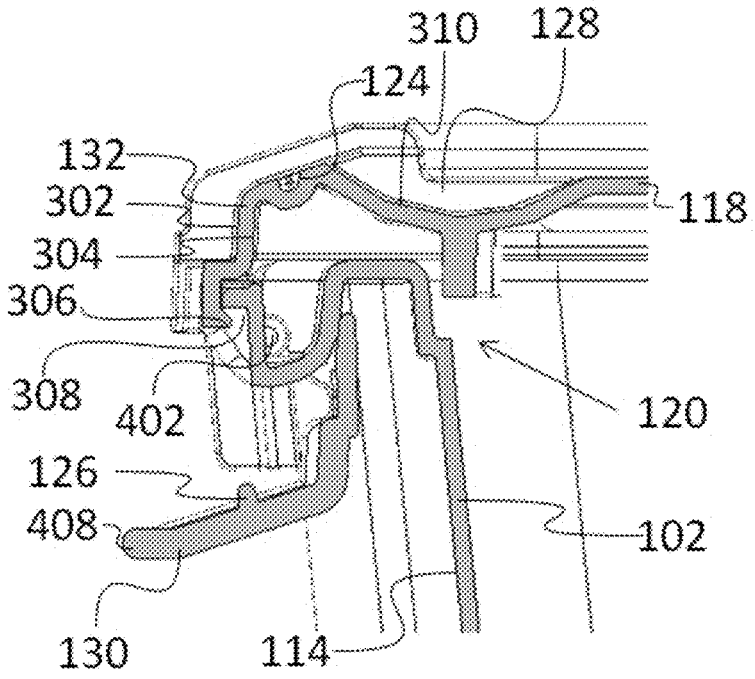
FIG. 3B is a cross-sectional view of FIG. 2, taken along line A-A, with the first releasable locking mechanism locked.
Figure 4A:
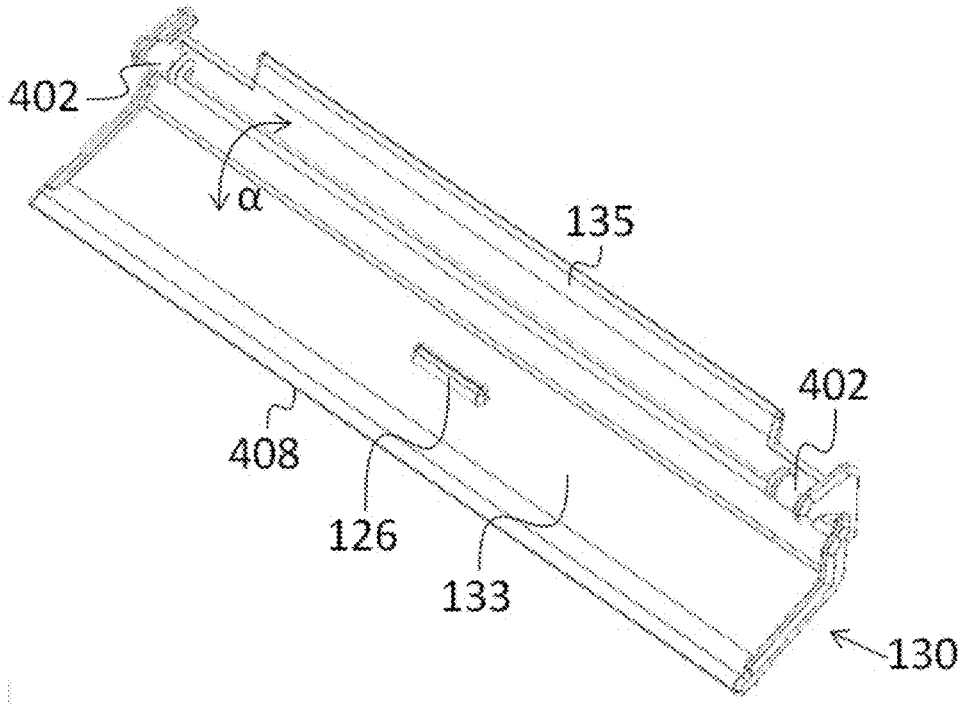
FIG. 4A is a perspective view of a latch of the embodiment of FIG. 1, with the latch in an open position.
Figure 4B:
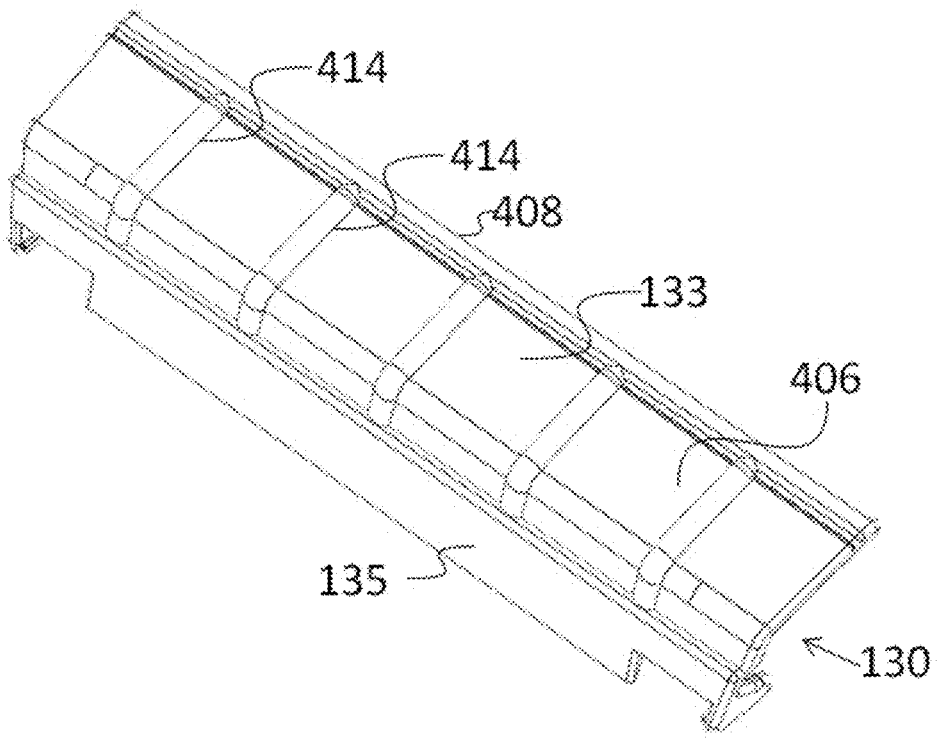
FIG. 4B is a perspective view of a latch of the embodiment of FIG. 1, with the latch in a closed position.

As shown in FIG. 1A, FIG. 1B, FIG. 3A, and FIG. 3B, the storage container 100 includes a second releasable locking mechanism. According to some embodiments of the present disclosure, the second releasable locking mechanism includes a latch 130 at each end wall 114, 116 that can pivot between a raised or locked position (FIG. 1A and FIG. 3A) and a lowered or unlocked position (FIG. 1B and FIG. 3B). As better shown in FIG. 4A and FIG. 4B, the latch 130 has an upper portion 133 and a lower portion 135.

The upper portion and the lower portion of each latch 130 define an angle $\alpha$between them ranging between about 100 degrees to 130 degrees. In some embodiments, the angle $\alpha$ is about 110.85 The configuration of the latch 130, including size and dimensions of the upper and lower portions 133, 135 and the angle $\alpha$, advantageously enable the latch 130 to conform to the profile of the periphery 122 of the lid 118 when the latch 130 is in the raised or locked position (FIG. 3A). The upper portion 133 on its inner surface includes a raised projection or male formation 126 (FIG. 4A) that is configured for an interference fit with a corresponding recess or female formation 124 formed in an outer surface at each end of the lid 118 such that the projection 126 releasably interlocks with a respective recess 124 in a press fit when each latch 130 is in the raised or locked position (FIG. 3A).

Although, in the illustrated embodiment, the recess 124 is a substantially vertical, curved indent, trench, or depression in the periphery 122 of the lid 118, the recess 124 in other embodiments may be any shape designed to receive a correspondingly configured raised projection 126. It is also understood that in other embodiments the raised projection 126 may be a female formation and the recess 124 may be a male formation.

In some embodiments, a concavity 128 is formed in an upper surface of the lid 118 adjacent an outer or distal edge 408 of a respective latch 130 in the locked position so as to facilitate user access to the edge 408 in releasing or lifting the projection 126 from the recess 124 in unlocking the latch 130. Accordingly, in some embodiments, the length of the latch 130 is a sufficient length to extend only partially over the concavity 128 to leave a gap for the user to access the distal edge 408. In some embodiments, each latch 130 and the lid 118 may be configured with multiple corresponding pairs of projections and recesses, as needed or desired to increase redundancy and further secure the lid 118 to the base 102 of the storage container 100. In the illustrated embodiment, the concavity 128 has a curved surface 310 with a depth sufficient to accommodate a portion of a user's fingers beneath the distal edge 408 of the latch 130.

The latch 130 is configured such that the lower portion 135 avoids obstruction of the fingerhold indentation 121 of the base 102 when the latch is in the lowered or unlocked position (FIG. 3B), while also shielding the snap-fit coupling between the projection 306 and the undercut 308 of the first releasable locking mechanism when the latch is in the raised or locked position (FIG. 3A). Indeed, the latch 130 is configured such that a user can in one movement insert fingers into the fingerhold indentation 121, pivot and lock the latch 130, and lift the storage container 100.

Figure 2:
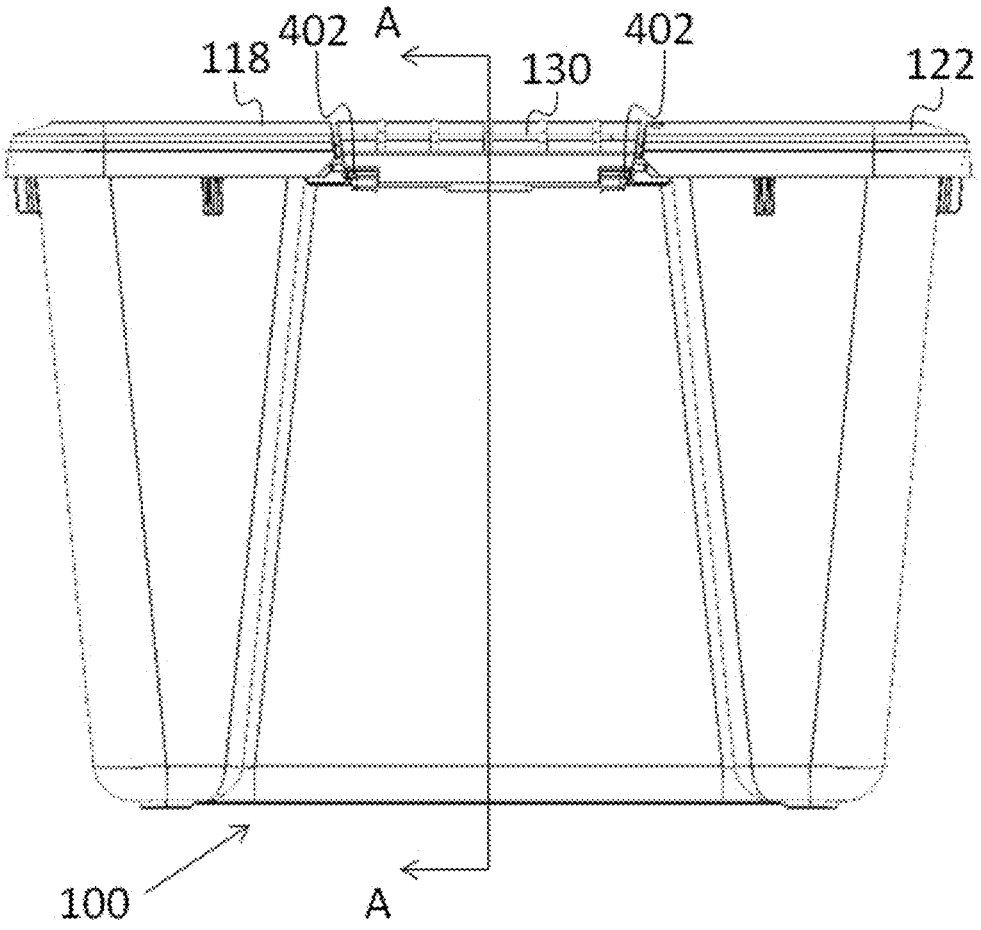
FIG. 2 is a side view of the storage container in FIG. 1A.

At each opposing end of the lower portion 135, a hinge mechanism including a generally cylindrical member 402 is provided to enable the latch 130 to pivot about an axis of rotation that is generally parallel to the adjacent end wall 114, 116 and lower than the undercut 308 relative to the upper lip 120 of the base 102. The generally cylindrical members 402 are received in a pair of oppositely-aligned through-holes in the upper lip 120 of the base 102, as shown in FIG. 2, FIG. 3A, and FIG. 3B. The cylindrical members 402 and the oppositely-aligned through-holes cooperate in enabling the latch 130 to pivot about 180 degrees between the locked and unlocked positions Although, in the illustrated embodiment, the latch 130 includes a pair of cylindrical members, the members may be any suitable shape and plurality allowing the latch 130 to shift around the upper lip 120 of the base 102 between an open position and a closed position, for example, in other embodiments, the latch 130 includes a single cylindrical member or one or more flexible members that bend instead of pivot.

In some embodiments, the second releasable locking mechanism is outside of the first releasable locking mechanism such that the second releasable locking mechanism is set/locked after the first or inner releasable locking mechanism is set/locked.

In some embodiments, an outer portion 406 of the latch 130 includes a plurality of parallel raised ridges 414 as a friction-inducing formation to increase tactile engagement between the user's fingers and the latch 130. The ridges 414 also improve structure integrity and rigidity of the latch 130. The ridges 414 may assume any suitable pattern. In the illustrated embodiment, the pattern is a grid aligned with the distal edge 408. The ridges 414 improve the durability of the latch 130 and conform to the profile of the upper portion 133 so as to allow a user to comfortably manipulate or rotate the latch 130 to engage or release the second releasable locking mechanism.

In use, the first releasable locking mechanism is set/locked when a user places the lid 118 on the base 102 and presses downwardly on the outer surface 302 of the lid 118 for a snap-fit engagement. By locking the first releasable locking mechanism, the user prevents visual and physical access to the contents in the interior volume V of the base 102.

As shown in FIG. 3A and FIG. 3B, after the lid 118 is placed on the base 102 and the first locking mechanism is locked, a user may lift the distal edge 408 of the latch 130 toward the lid 118 to pivot the latch 130 about the cylindrical members 402. As the user continues to lify the distal edge 408 toward the lid 118, the latch 130 loosely wraps around an end portion 132 of the periphery 122 the lid 118. Alternatively, the user may flip the latch 130 about the cylindrical members 402 by brushing or striking the outer portion 406 of the latch 130 to achieve the same effect.

After the latch 130 has pivoted into a position loosely wrapped around the lid 118, the user presses downwardly on the upper portion 133 of the latch 130 to move (or snap) the latch 130 into the closed position thereby engaging a projection 126 with a corresponding recess 124 for a snap-fit engagement of the second releasable locking mechanism.

To release/unlock the second locking mechanism, the user inserts his/her fingers into the concavity 128 formed in the periphery of the lid 118 and grasps or lifts the distal edge 408 of the latch 130. Lifting the distal edge 408 away from the lid 118 releases the snap-fit engagement of the second releasable locking mechanism and moves the latch 130 from the closed position to the open position. As the user continues to lift the distal edge 408 away from the lid 118, the latch 130 pivots about the cylindrical members 402 until dropping into a fully open position. Accordingly, the end portion 132 of the periphery 122 of the lid 118 is exposed to the user (i.e., the latch 130 no longer wraps around the periphery 122 of the lid 118) and the second locking mechanism is released/unlocked.

To release/unlock the first releasable locking mechanism, a user pulls outwardly (e.g., away from the undercut 308) on the inwardly-facing projection 306 to disengage it from the undercut 308 in the upper lip 120 of the base 102. After the inwardly-facing projection 306 has been disengaged from the undercut 308, the lid 118 may be lifted by the user to expose the interior volume V of the base 102. In other words, to visually or physically access the contents through the upper opening, the first releasable locking mechanism must be released/unlocked to allow a user to lift the lid 118 and expose the contents in the interior volume V of the base 102 for inspection or removal. Accordingly, the lid 118 may be releasably attached to the upper lip 120 of the base 102 according to the first releasable locking mechanism.

In the illustrated embodiment, the latch 130 includes an angled cross-section to better conform to the lid 118 and the latch 130 is a sufficient length to wrap around the end portion 132 of the periphery 122 of the lid 118. Preferably, the latch has a length allowing a user to easily lift the distal edge 408 of the latch 130 or flip the latch 130 by brushing or striking the outer portion 406 of the latch 130 as described above. Although in the illustrated embodiment, the latch includes an angled cross-section, in other embodiments, the shape of the latch may vary as long as the latch 130 is a suitable shape for wrapping around the end portion 132 of the periphery 122 of the lid 118.

Figure 5A:
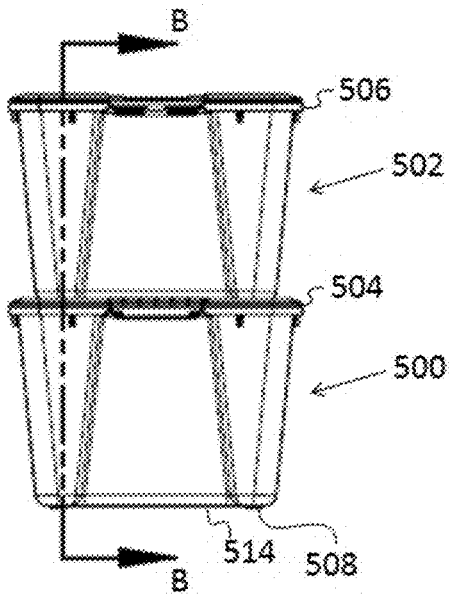
FIG. 5A is a side view of a first and a second storage container stacked according to another embodiment of the present disclosure.
Figure 5B:
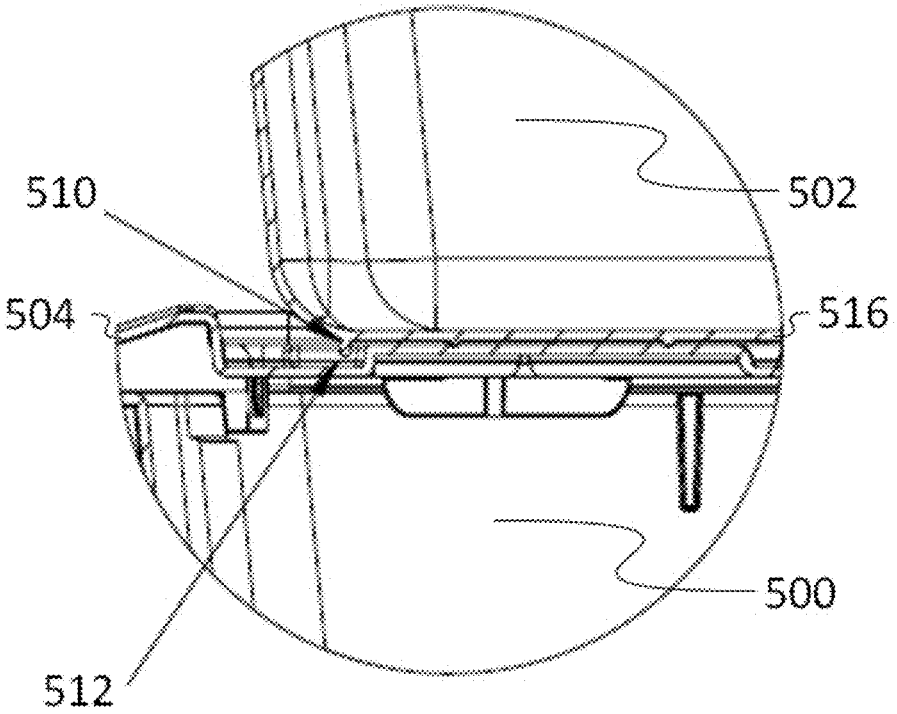
FIG. 5B is a cross-sectional view of FIG. 5A, taken along line B-B.

With reference now to FIG. 5A and FIG. 5B, according to some embodiments of the present disclosure, a first storage container 500 includes a first detachable lid 504 opposing a first bottom 516 with one or more feet 510 protruding away from the first bottom 516, and a second storage container 502 includes a second detachable lid 506 opposing a second bottom 514 with one or more feet 508 protruding away from the second bottom 514. As shown in FIG. 5B, the first detachable lid 504 has one or more grooves 512 configured to support one or more feet 508 of the second storage container 502. Therefore, the first storage container 500 and the second storage container 502 may be stacked as shown in FIG. 5A.

Figure 6A:
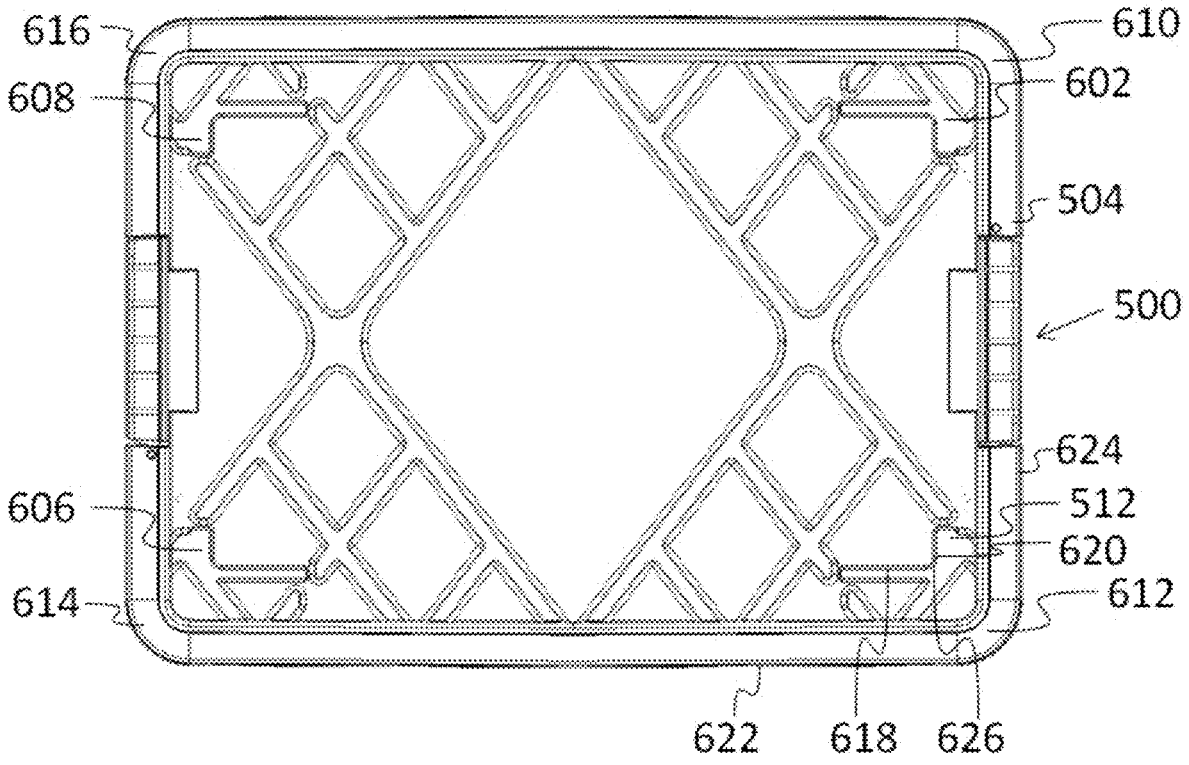
FIG. 6A is a top view of the first storage container of FIG. 5A.

With reference now to FIG. 6A, the detachable lid 504 according to some embodiments of the present disclosure includes one or more L-shaped recessed grooves configured to accommodate corresponding legs of the second storage container 502. In the illustrated embodiment, the lid 504 has four grooves 512, 602, 606, 608, each adjacent to respective corners 612, 610, 614, 616 of the lid 504. The L-shaped grooves each include two legs, each leg being substantially parallel to a corresponding side of the detachable lid (e.g., an adjacent side). For example, the groove 512 includes a first leg 618 and a second leg 620. The first leg 618 is substantially parallel to a first side 622 of the detachable lid 504, and the second leg 620 is substantially parallel to a second side 624 of the detachable lid 504. In some embodiments, the first leg 618 is longer than the second leg 620 and the first side 622 is longer than the second side 624. Although in the illustrated embodiment, the grooves are L-shaped, in some embodiments, the grooves are a different suitable shape such as a jagged shape or curved shape.

In some embodiments, the two legs 618, 620 form a generally 90 degree angle with a curved portion 626 between the two legs 618, 620. In the illustrated embodiment, each leg faces another leg corresponding to a separate groove in the lid 504. For example, the first leg 618 faces a corresponding leg of the groove 602, and the second leg 620 faces a corresponding leg of the groove 606.

Figure 6B:
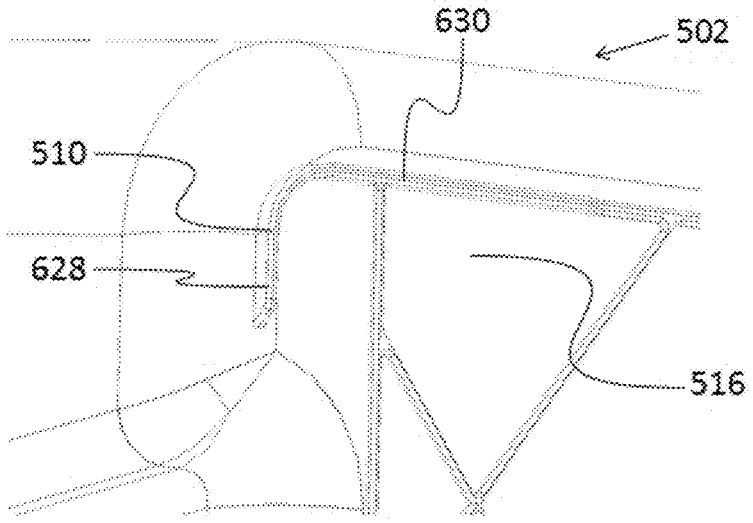
FIG. 6B is an enlarged perspective view of the bottom of the second storage container of FIG. 5A.

With reference now to FIG. 6B, the second storage container 502 includes one or more L-shaped feet 510 protruding from the bottom 516 of the second storage container 502. Each of the one or more L-shaped feet 510 includes a first and a second protrusion 628, 630 configured to fit in corresponding legs 620, 618 of groove 512 as shown in FIG. 5B and FIG. 6A. Although in the illustrated embodiment, the feet are L-shaped, in some embodiments, the feet are a different suitable shape that fit within corresponding grooves in the lid of another storage container.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. It is understood that the drawings are not necessarily to scale and that any one or more features of an embodiment may be incorporated in addition to or in lieu of any one or more features in another embodiment. Although relative terms such as "outer," "inner," "upper," "lower," "below," "above," "vertical," "horizontal," and similar terms have been used herein to describe a spatial relationship of one element to another, it is understood that these terms are intended to encompass different orientations of the various elements and components of the invention in addition to the orientation depicted in the figures. As used herein, the terms "about" or "approximately" for any numerical values or ranges indicate a suitable dimensional tolerance that allows the part or collection of components to function for its intended purpose as described herein. More specifically, "about" or "approximately" may refer to the range of values ±20% of the recited value, e.g. "about 90%" may refer to the range of values from 71% to 99%. In addition, as used herein, the terms "patient," "host," "user," and "subject" refer to any human or animal subject and are not intended to limit the systems or methods to human use, although use of the subject invention in a human patient represents a preferred embodiment. Moreover, the tasks described above may be performed in the order described or in any other suitable sequence. Additionally, the methods described above are not limited to the tasks described. Instead, for each embodiment, one or more of the tasks described above may be absent and/or additional tasks may be performed. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A storage container comprising:

a lid having:

a periphery end portion with a generally-vertical L portion;

an inwardly-facing projection extending from the generally-vertical L portion; and a first element selected from the group consisting of a male element and a female element;

a base having:

an upper lip with a fingerhold indentation and an undercut, the fingerhold indentation having an upside down U shape cross section;

a latch with a first portion and a second portion extending at an angle from the first portion, the second portion being hinged to the upper lip, the first portion having a second element selected from the group consisting of the male element and the female element;

a first releasable locking mechanism including a snap-fit coupling between the inwardly-facing projection and the undercut of the upper lip; and a second releasable locking mechanism including an interference fit between the first element and the second element.

2. The storage container of claim 1, wherein the second releasable locking mechanism is outside of the first releasable locking mechanism when the first and second releasable locking mechanisms are both in their locked positions.

3. The storage container of claim 1, wherein the second releasable locking mechanism generally encloses the first releasable locking mechanism when the first and second releasable locking mechanisms are both in their locked positions.

4. The storage container of claim 1, wherein the first portion and the second portion define an angle therebetween.

5. The storage container of claim 4, wherein the second element is formed on the first portion of the latch.

6. The storage container of claim 4, wherein the latch extends over an end portion of a periphery of the lid when the second releasable locking mechanism is in its locked position.

7. The storage container of claim 4, wherein the second portion includes a generally cylindrical member defining a pivot axis about which the latch is configured to move between a locked position and an unlocked position.

8. The storage container of claim 1, wherein the fingerhold indentation is configured to remain generally unobstructed by the latch whether the latch is in a locked position or an unlocked position.

9. The storage container of claim 1, further comprising an additional first releasable locking mechanism and an additional second releasable locking mechanism at an end of the storage container opposite the first releasable locking mechanism and the second releasable locking mechanism.

10. A storage container comprising:

a lid having:

a periphery end portion with a generally-vertical L portion;

an inwardly-facing projection extending from the generally-vertical L portion; and a first element selected from the group consisting of a male element and a female element;

a base having:

an upper lip with a fingerhold indentation and an undercut, the fingerhold indentation having an upside down U shape cross section;

a latch with a first portion and a second portion extending at an angle from the first portion, the second portion being hinged to the upper lip, the first portion having a second element selected from the group consisting of the male element and the female element;

a first releasable locking mechanism including a snap-fit coupling between the inwardly-facing projection and the undercut of the upper lip; and a second releasable locking mechanism including an interference fit between the first element and the second element, wherein, when the lid is secured on the base by the first and second releasable locking mechanisms, the first portion of the latch covers the male and female elements and the second portion of the latch extends over the inwardly-facing projection and the undercut.

11. The storage container of claim 10, wherein the second releasable locking mechanism generally encloses the first releasable locking mechanism when the first and second releasable locking mechanisms are both in their locked positions.

12. The storage container of claim 10, wherein the first portion and the second portion define an angle therebetween.

13. The storage container of claim 12, wherein the second portion includes a generally cylindrical member defining a pivot axis about which the latch is configured to move between a locked position and an unlocked position.

14. The storage container of claim 13, wherein the lid has a concavity formed in an upper surface of the periphery of the lid.

15. The storage container of claim 14, wherein the latch extends over an end portion of the periphery of the lid and extends partially over the concavity when the second releasable locking mechanism is in its locked position.

16. The storage container of claim 15, wherein the fingerhold indentation is configured to remain generally unobstructed by the latch whether the latch is in a locked position or an unlocked position.

17. The storage container of claim 10, wherein the lid has a plurality of grooves configured to enable another base to be stacked on the lid.

18. The storage container of claim 17, wherein each of the plurality of grooves has an L-shape and each leg of the L-shape is parallel to an edge of the lid.

* * * * *